United States Patent [19]

Skow

[11] 4,312,321

[45] Jan. 26, 1982

[54] HEAT EXCHANGER CONSTRUCTION FOR SOLID FUEL BURNING FURNACE

[75] Inventor: Lynn R. Skow, North Branch, Minn.

[73] Assignee: Gemini Systems, Inc., North Branch, Minn.

[21] Appl. No.: 137,852

[22] Filed: Apr. 7, 1980

[51] Int. Cl.[3] ..... F24H 3/00

[52] U.S. Cl. ..... 126/99 A; 126/110 R

[58] Field of Search ..... 126/110 E, 110 R, 121, 126/99 A, 99 D, 83, 391, 360 R; 237/55; 165/67; 110/322

[56] References Cited

U.S. PATENT DOCUMENTS

| | | | |
|---|---|---|---|
| 92,822 | 7/1869 | Hart | 126/99 P |
| 726,374 | 4/1903 | Thompson | 126/99 A |
| 2,309,356 | 1/1943 | Peterson | 126/110 E X |
| 3,813,039 | 5/1974 | Wells | 237/55 |
| 4,201,187 | 5/1980 | Skow | 126/99 A |
| 4,204,518 | 5/1980 | Smith | 126/5 X |

FOREIGN PATENT DOCUMENTS

| | | | |
|---|---|---|---|
| 55147 | 5/1890 | Fed. Rep. of Germany | 126/99 A |
| 1017721 | 12/1952 | France | 126/110 E |

*Primary Examiner*—Samuel Scott

*Assistant Examiner*—Randall L. Green

*Attorney, Agent, or Firm*—Orrin M. Haugen; Thomas J. Nikolai

[57] ABSTRACT

A heat exchanger construction for use in a solid fuel burning heating system. A plurality of tubular members are provided for receiving hot, smoke laden gases and directing said gases through the zone in which clean, forced air to be heated is present. The tubes are supported between two parallel, spaced apart support plates having apertures formed therethrough for receiving opposed ends of the tubes. A clean-out box is provided at one end of the heat exchanger tubes and because a predetermined spacing is maintained between the rear surface of the clean-out box and one of the two support plates, it is possible to utilize an inexpensive tack weld to hold the parts in place, rather than a 360° welded seam between the tubes and the support plate through which they pass. That is, the pressure differentials resulting from the construction ensure that no smoke laden gases will enter the clean air zone, even upon occurrence of pressure reversals in the chimney flue, thereby obviating the necessity of a totally welded seal between the heat exchanger tubes and the support plate and clean-out box through which the tubes pass.

5 Claims, 2 Drawing Figures

HEAT EXCHANGER CONSTRUCTION FOR SOLID FUEL BURNING FURNACE

BACKGROUND OF THE INVENTION

I. Field of the Invention

This invention relates generally to solid fuel burning furnace systems, and more specifically to the construction of a heat exchanger for use therein.

II. Discussion of the Prior Art

In my copending U.S. Pat. No. 4,201,187, filed Sept. 8, 1978, and entitled "Modular Solid Fuel Furnace System", I describe in detail the construction of a solid-fuel burning furnace system of the type in which the heat exchanger of the present invention finds use. As is set out in that patent application, the heat exchanger comprises a plurality of horizontally extending tubes which are effectively divided into first and second sets by means of suitably placed baffles. The tubes are supported at each end by means of spaced apart vertically extending support plates having apertures formed therethrough for receiving the ends of the heat exchanger tubes. The heat exchanger is positioned within the furnace cabinet such that hot, smoke laden gases are drawn from the firebox, through a first set of the plurality of tubes in a first direction and through the second set in the opposite direction and from there through the flue and chimney. A clean-out door is provided in the cabinet to provide access to a first end of each of the tubes whereby soot and creosote like deposits could be periodically scraped from the inside surfaces of the heat exchanger tubes.

Clean air to be heated is made to pass over the exterior surfaces of the first and second sets of tubes comprising the heat exchanger. To avoid "cross-talk" between the hot, smoke laden and potentially lethal gases flowing through the interior of the heat exchanger tubes and the clean forced air to be circulated through the building to be heated, it had been necessary to form a 360° weld at the intersections of each of the heat exchanger tubes and the support plates through which these tubes pass. Such a welding process, being somewhat labor intensive, added significantly to cost of the furnace system. Thus, a need existed for a heat exchanger construction which could eliminate the need for the 360° seam weld without jeopardizing the safety of the occupants of the building utilizing the system.

The present invention comprises an improvement over the heat exchanger construction disclosed in the aforereferenced patent application. By creating a buffer zone between the front heat exchanger support plate and the rear surface of the clean-out box, the possibility for the aforementioned "cross-talk" is eliminated without the need for a weld extending completely around the perimeter of the heat exchanger tubes at their intersections with the front support plate and the rear surface of the clean-out box. Only a tack weld at predetermined points along the perimeter are necessary, these tack welds serving to hold the support plate and clean-out box relative to the heat exchanger tubes passing therethrough.

SUMMARY OF THE INVENTION

In accordance with the present invention, the heat exchanger construction again comprises a plurality of tubular members which are held in a parallel and spaced apart relationship by virtue of the fact that the opposed ends of the tubes are inserted through apertures formed in parallel, spaced apart support plates. However, in further accordance with the present invention, the tubular members are held in position as by tack welding at one or more local points proximate the intersection of the tubular members with the front support plate. Rather than utilizing the front support plate as the rear member of the clean-out box as in the furnace of the above-identified patent application, in accordance with the present invention, there is provided a second plate member which is also apertured to receive the ends of the plural heat exchanger tubes but this additional plate is positioned outwardly from the front support plate, this additional plate comprising the rear surface of a clean-out box. A clean-out access door is designed to cover the clean-out box when it is closed about its hinge connection. Further, the clean-out box serves as a manifold where the hot, smoke laden gases are re-routed to the second set of heat exchanger tubes for travel to the flue. The spacing between the front support plate and the plate comprising the clean-out box creates a buffer zone which is at ambient pressure. A positive pressure normally exists exterior to the heat exchanger tubes, especially when the fan of the forced air heating system is operational. The interior of the heat exchanger tubes are normally at a negative pressure in that one end of each of the tubes in a predetermined set couple into a manifold which is arranged to be connected by a flue pipe to the building's chimney. As such, there is normally no opportunity for harmful waste gases to pass between the gap which may exist between the heat exchanger tubes and the support plates. However, it is possible for pressure reversals to take place, especially when the forced air blower is not running. Because down drafts and the like on the chimney can result in unwanted leakage of noxious gases into the clean air zone of the furnace, it has been the practice to provide a complete 360° welded seam at the juncture of the heat exchanger tubes with the front support plate. However, because of the buffer established by the predetermined spacing between the front support plate and the rear of the plate comprising the clean-out box, this possibility of unwanted gas leakage is reduced essentially to zero, thus allowing less expensive tack welding rather than a complete seal between the exterior of the heat exchanger pipes and the plates through which these heat exchanger pipes pass.

OBJECTS

It is accordingly the principal object of the present invention to provide a new and improved construction for a heat exchanger suitable for use in a solid fuel furnace system.

Another object of the invention is to provide a heat exchanger design which can be constructed more economically than known prior art arrangements.

A still further object of the invention is to provide a heat exchanger construction in which a plurality of tubular members may be suspended between spaced apart support plates, the assembly being held together by tack welding rather than by a 360° seam.

A still further object of the invention, related to the immediately foregoing object, is to provide a heat exchanger construction which eliminates the danger that noxious and possibly posionous gases given off by the burning of the solid fuel can contaminate the forced air which is circulated through the building being heated.

These and other objects and advantages of the invention will become apparent to those skilled in the art from the following detailed description of a preferred embodiment, when considered in conjunction with the accompanying drawings.

DESCRIPTION OF THE PREFERRED EMBODIMENT

Figure 1:
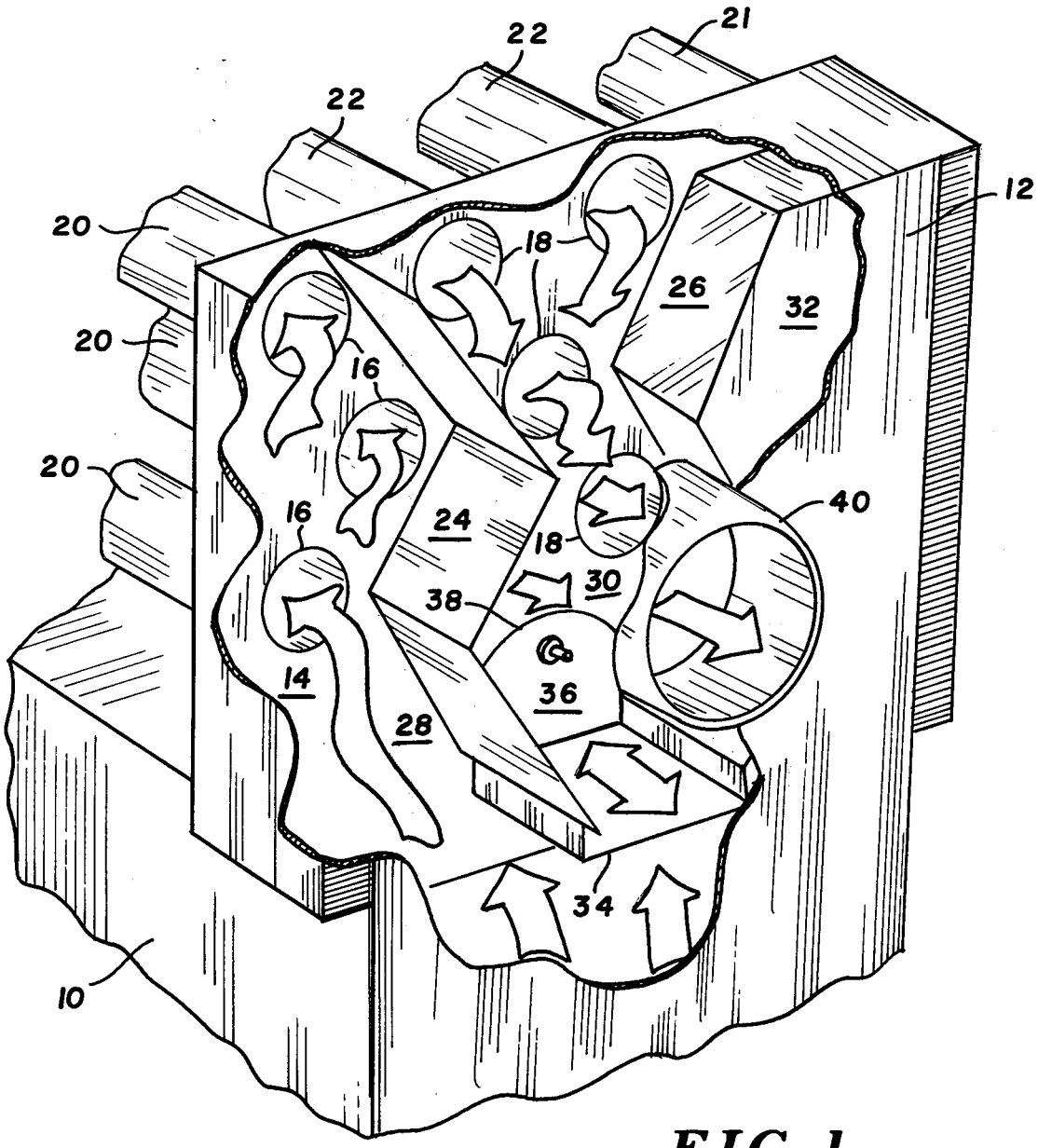
FIG. 1 is a partial perspective view of the rear portion of a solid fuel burning furnace in which the heat exchanger of the present invention is used.
Figure 2:
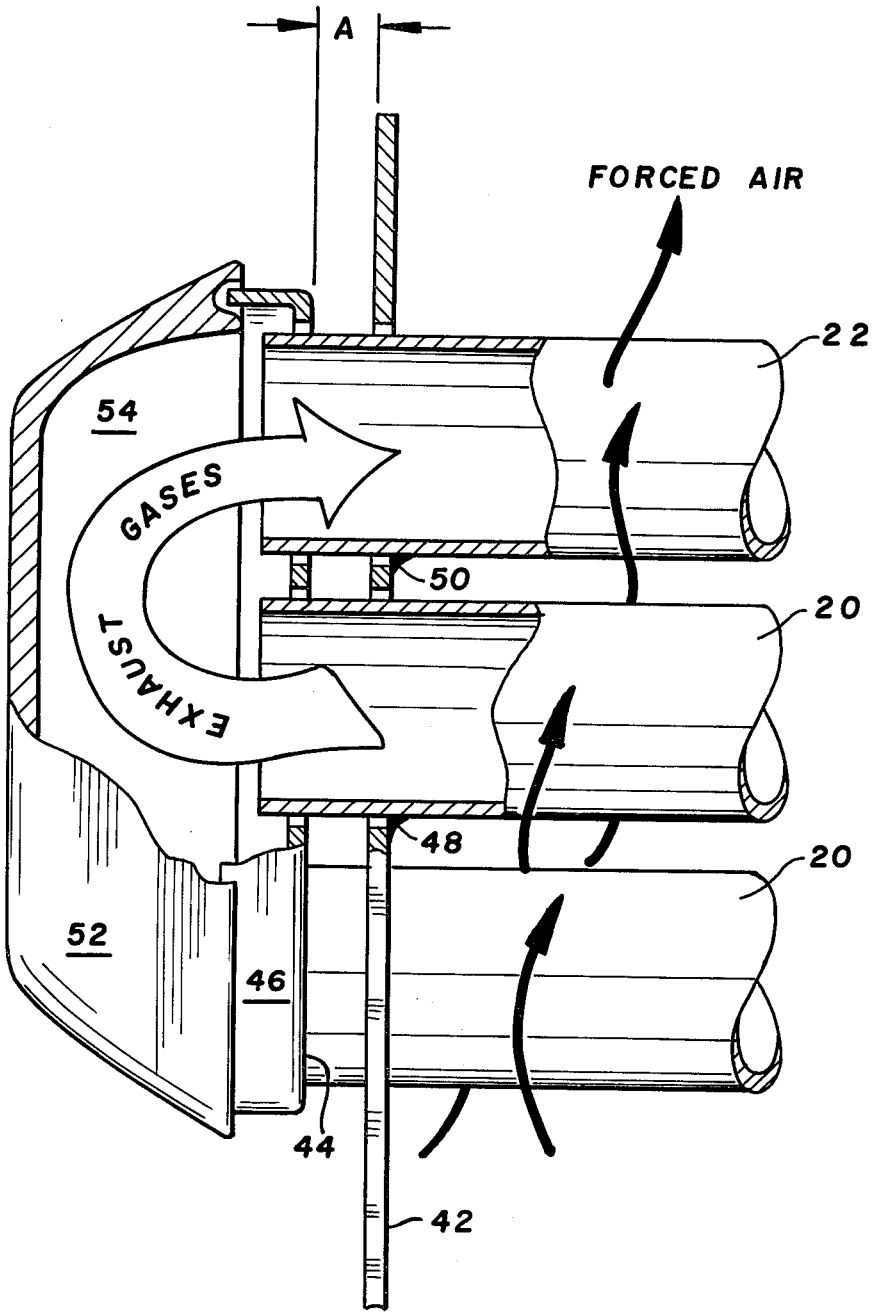
FIG. 2 is a side, partially cross-section, view of the front portion of the heat exchanger of the present invention.

Before describing the details of the present invention, reference is made to FIGS. 1–3 of my U.S. Pat. No. 4,201,187 filed Sept. 8, 1978, and to those portions of the specification which set forth the general construction of the solid fuel burning furnace in which the heat exchanger constructed in accordance with the present invention finds use. With that information as background, those skilled in the art will readily perceive the overall environment in which the present invention may find utility.

Referring next to FIG. 1, there is shown by means of a partially cut-away, perspective view of the upper rear portion of the firebox and the secondary heat exchanger portion of the furnace assembly. More specifically, there is identified by numeral 10 one side wall of the firebox, the firebox being formed from heavy gauge sheet steel. Secured to the upper rear portion of the firebox is a manifold 12 in the form of a generally rectangular enclosure having a generally open bottom to allow the passage of smoke and other products of combustion emanating from below the grate (not shown) to flow into the manifold. Formed in the interior wall 14 of the manifold box 12 are a plurality of apertures as at 16 and 18 into which are fitted a plurality of heat exchanger tubes as at 20 and 22. Baffle plates 24 and 26 effectively divide the manifold box 12 into three separate compartments 28, 30 and 32. A channel member 34 is welded or otherwise affixed to a smoke door 36 and when the smoke door 36 is closed against a circular aperture 38 formed in the rear wall 14 of the firebox, the channel 34 blocks the flow of smoke laden gases directly into the chamber 30.

Formed in the outer wall of the manifold 12 and communicating with the center chamber 30 of that manifold is a tubular breech 40 which is adapted to be connected by a flue pipe to a conventional chimney in the building being heated. Thus, a negative pressure is normally maintained within the center chamber 30 relative to that maintained in the two outer chambers 28 and 32. As such, the smoke laden gases pass through the open bottom of the manifold 12 and flow through the outer sets of heat exchanger tubes 20 and 21 to the front manifold (not shown in FIG. 1) and from there through the centrally located heat exchanger tubes 22 into the center compartment 30 of the manifold box 12. Thus, it can be seen that the heated, smoke laden gases effectively make two passes across the length dimension of the heat exchanger, first in a rear to front direction and secondly in a front to rear direction, thereby giving up heat by conduction through the heat exchanger tubes to the forced fresh air which is made to pass over the exterior of these heat exchanger tubes.

When the smoke door 36 is opened by pulling on a rod exiting from the front of the furnace cabinet, all as is explained in the aforereferenced co-pending patent application, the channel 34 slides with it and opens the bottom of the chamber 30 defined by the baffle members 24 and 26 to the smoke laden gases. As such, the smoke laden gases flow directly into the chamber 30 and out the breech 40 rather than traversing through the outer heat exchanger tubes and back through the inner set of tubes.

Referring next to FIG. 2, there is shown by means of a partial cross-sectional view the front portion of the heat exchanger assembly. As used herein, the terms "front" and "rear" have the same meaning as used in my co-pending patent application referenced above.

The heat exchanger tubes 20 and 22 pass through circular apertures formed in the front plate 42 of the firebox assembly as illustrated. The ends of each of the tubes in each set extend forwardly of the front plate 42 by a predetermined distance and enter corresponding circular apertures formed in the rear plate 44 of a generally open rectangular clean-out box member 46. A predetermined spacing, A, is maintained between the front plate 42 and the rear surface 44 of the box member 46.

It is to be noted that the ends of the heat exchanger tubes may have a diameter which is undersized in comparison to the diameter of the apertures formed in the plates 42 and 44, such that the heat exchanger tube ends may be easily fitted through these apertures. An important feature of the construction of the present invention is that only a tack weld, as at 48 and 50, need be used to secure the parts relative to one another and, specifically, it is not required that the gap existing between the outer diameter of the heat exchanger tubes and the apertures formed in the front plate 42 or the rear plate 44 of the clean-out box 46 be totally sealed by a 360° seam weld. The reason for this will be set forth more fully hereinbelow, but first the remaining features of the assembly depicted in FIG. 2 will be explained.

Hinged to the lip of the clean-out box 46 is a clean-out door 52 which is configured so that, when closed, it cooperates with the box 46 to define a manifold compartment 54 which allows the exhaust gases emanating from the front ends of the outermost set of heat exchanger tubes to reverse in direction and to flow into the front ends of the center set of heat exchanger tubes 22 which are associated with the center compartment 30 of the rear manifold 12 of FIG. 1. Upon opening of the door 52, access may be had to the interior surfaces of the heat exchanger tubes in both the outer and inner sets so that creosote and other soot and particulate matter may be brushed or scraped by pushing a suitable tool down these tubes. The waste material is thus deposited back into the firebox where it falls through the grate allowing ultimate clean-out at the base of the furnace assembly, all as can be readily visualized by reference to my aforereferenced pending patent application.

In prior art constructions of secondary heat exchangers for use in furnaces of the type described, the practice was to terminate the end of the heat exchanger tubes flush with the exposed outer surface of the front plate 42. Because of the possibility that exhaust gases containing carbon monoxide and other noxious components might, under some circumstances, flow backward from the ends of the heat exchanger tubes and into the forced clean air zone, the practice has been to provide a 360° seam weld between the tube ends and the front plate through which they pass. This approach tends to be quite costly and with a heat exchanger of any size, it requires extensive welding to ensure a gas-tight seal.

I have found that by extending the heat exchanger tubes a short predetermined distance beyond the front surface of the front panel 42 and by attaching a separate clean-out box member 46 to the ends of the heat exchanger tubes, but spaced from the front plate 42 by a predetermined distance, A, that no exhaust gases are able to find their way back into the forced clean air zone even when a gap exists between the outer surface of the heat exchanger tubes and the apertures formed in the front support plate. As such, it is only necessary to utilize a tack weld at selected discrete points to mechanically fasten the parts together, it being unnecessary to provide a complete gas-type welded seal therebetween. More particularly, I have found that by adjusting the predetermined spacing, A, to lie in the range of from 0.5 inches to approximately 1.5 inches, no smoke, odors, or the presence of noxious gases has been detected in the forced clean air made to flow over the exposed exterior surfaces of the heat exchanger. This is so even though pressure reversals have been allowed to take place whereby the normally negative pressure maintained in the heat exchanger tubes is made to exceed the pressure maintained in the forced clean air zone. The air space between the surfaces 42 and 44 are at ambient pressure, i.e., the pressure existing in the room where the furnace is located and, hence, this space serves as a buffer zone with respect to the clean forced air passing over the heat exchanger and the smoke laden air within the clean-out box manifold.

Thus it can be seen that I have described a heat exchanger apparatus and a method of fabricating same which permits lower cost assembly without a sacrifice in safety. Those skilled in the art may discern ways of modifying the present invention as it is particularly described and illustrated herein, without really departing from the true spirit and scope of the invention. Accordingly, it is intended that the true scope of the invention be determined from the appended claims.

What is claimed is:

1. A heat exchanger for a furnace system, comprising:

(a) a first manifold member having a box-like enclosure with baffle means contained therein for dividing said box-like enclosure into a plurality of chambers, said enclosure having a generally open side wall for allowing noxious gases to enter therein and into one or more of said chambers, a rear plate having a plurality of apertures formed therethrough, each of said chambers having at least one of said apertures communicating therewith, and a front plate with an aperture communicating with only one of said plurality of chambers;

(b) a support plate having a plurality of apertures formed therethrough in a pattern corresponding to the pattern of said plurality of apertures formed in said rear plate of said first manifold member;

(c) a plurality of elongated tubular members extending between said rear plate and said support plate and maintained in a parallel and spaced apart orientation with respect to one another, said tubular members each having their opposed ends extending through aligned pairs of said apertures in said rear plate and said support plate with a predetermined tolerance between said tubular members and said support plate, said tubular members being fastened to at least said support plate by a tack weld with the ends of said tubes extending beyond a front surface of said support plate by a predetermined distance; and (d) a second manifold member having a box-like enclosure comprised of an end plate and four integrally formed side walls extending perpendicularly to said end plate, said end plate having a pattern of apertures corresponding to said pattern of apertures on said support plate, said second manifold member being mounted on said ends of said tubes extending beyond said front surface of said support plate with a predetermined spacing between said end plate of said second manifold member and said front surface of said support plate said apertures of said end plate and said tubes also having a predetermined tolerance therebetween.

2. The heat exchanger of claim 1 wherein said end plate of said second manifold member is tack welded to at least one of said tubular members to thereby hold said end plate of said second manifold member at said predetermined distance from the front surface of said support plate.

3. The heat exchanger of claim 1 and further including a door member hingedly mounted with respect to said second manifold member so that when closed, said door member forms a cover for said box-like enclosure of said second manifold member.

4. The heat exchanger as in claim 1 wherein said predetermined spacing between said support plate and said end plate of said second manifold member is in the range of from 0.5 to 1.5 inches.

5. The heat exchanger as in claim 1 wherein said aperture in said front plate of said first manifold member is adapted to be joined to a flue pipe.

* * * * *